United States Patent [19]

Ruth-Larson et al.

[11] Patent Number: 4,535,481

[45] Date of Patent: Aug. 20, 1985

[54] SURGICAL GOWN FOR HIGH FLUID PROCEDURES

[75] Inventors: Dawn Ruth-Larson, Norcross, Ga.; James S. Nels, Montclair, N.J.

[73] Assignee: Kimberly-Clark Corporation, Neenah, Wis.

[21] Appl. No.: 630,475

[22] Filed: Jul. 12, 1984

[51] Int. Cl.[3] ..... A41B 9/00

[52] U.S. Cl. ..... 2/114; 2/243 B

[58] Field of Search ..... 2/51, 59, 105, 114, 2/DIG. 7, 243 R, 243 B

[56] References Cited

U.S. PATENT DOCUMENTS 3,868,728 3/1975 Krzewinski ..... 2/114

4,205,398 6/1980 Blume ..... 2/114

*Primary Examiner*—Doris L. Troutman

*Attorney, Agent, or Firm*—William D. Herrick

[57] ABSTRACT

A back opening gown of nonwoven material is provided having a pair of sleeves, a front panel joined at its upper lateral edges to the sleeves, the front panel flaring pronouncedly below the sleeves, and a pair of side panels attached to the sleeves and to the lateral edges of the front panel below the sleeves, each of the side panels having a lower opposed corner section which forms an obtuse angle with respect to the bottom edge of the front panel. The upper portion of the gown conforms substantially to the torso of a wearer. The gown extends from the neck to the ankles of the wearer and the flaring front panel provides girth to the lower portion of the gown to permit the wearer to spread his legs while in a seated position without being constrained by the gown material. The angled edges of the corner sections cause the edges of the sections to be located clear of a floor while the wearer is seated.

12 Claims, 5 Drawing Figures

27
37
16
16
16
16

16
27

SURGICAL GOWN FOR HIGH FLUID PROCEDURES

TECHNICAL FIELD

The present invention relates to nonwoven back-opening gowns useful in high fluid procedures. More particularly, the present invention relates to gowns which are suited for high fluid surgical procedures in which the wearer often assumes a sitting position.

BACKGROUND ART

As is generally known, when used in the sterile environment of an operating room, a surgeon's gown must prevent contamination of the patient, surgical instruments and other personnel which might occur from contact with the wearer. The gown should also prevent the clothes of the wearer from coming in contact with blood and other liquids generated during surgical procedures.

Surgical gowns were originally made of cotton or linen and were sterilized prior to use in the operating room. These gowns, however, permitted penetration or "strike-through" of the various liquids encountered in surgical procedures, resulting in the soiling of the wearer's clothes and allowing, in some instances, a path to be established for transmission of bacteria to and from the wearer of the gown. Another disadvantage of the materials used in these gowns is that they tend to form lint which is capable of becoming airborne or clinging to the clothes of the wearer, thereby providing another potential source of contamination. Since these gowns were costly, laundering and sterilization procedures were required before re use.

Disposable surgical gowns have largely replaced the linen surgical gown and many are now made in part or entirely from fluid repellent or impervious fabrics to prevent strike-through.

Many surgical procedures, such as arthroscopies, cystoscopies and craniotomies, to name only a few, by their nature involve large volumes of fluid. To be suitable for such surgical operations, an operating room gown must provide sterility while affording the wearer adequate protection from the high potential for strike-through by the liquids generated in such procedures.

Many of these procedures require the operating surgeon to be mobile and to assume a sitting position. Thus, the surgeon may be required to move to different positions around the operating table without rising. This may be accomplished by using a movable stool provided with wheels or rollers in its base or legs. In order to shift positions along the operating table or to more closely approach the operating table, the surgeon frequently is required to spread his legs apart. Conventional surgical gowns generally have configurations which do not provide for sufficient movement of the lower extremities, particularly while in a sitting position. Although the surgeon has had the option, heretofore, of using a larger gown, this solution also has certain associated shortcomings. Specifically, the limited conformity of the generally planar structure of the gown, particularly of the disposable type, to the non-planar form of the wearer and the excess portions of material located in the chest, shoulder and underarm regions, which material in a disposable garment frequently lacks drape and hand, causes a ballooning or bunching up of material which results in annoyance and distraction to the surgeon.

Other requirements of surgical gowns suitable for use in high fluid procedures are imperviousness to liquids and full coverage of the wearer. Thus, the gown must provide adequate protection against strike-through, should be so configured to minimize large numbers of folds which could trap liquids, and should be so dimensioned as to cover most of the body surface between the wearer's feet and neck.

A further problem of back-opening surgical gowns of the type which are configured in the lower extremities so as to provide sufficient girth to permit the wearer to separate his legs widely is the tendency for the lower corners of the side or back flaps to drag on the operating room floor when the wearer assumes a sitting position. This presents a potential safety hazard if the trailing corners are sufficiently long to become caught beneath the wheels or rollers of the stool, or the feet of the surgeon or other operating room personnel. It is also undesirable in a high fluid environment to have the gown drag on a wet floor.

DISCLOSURE OF INVENTION

The present invention relates to back-opening gowns suitable for use during high-fluid procedures and particularly suitable for use as surgical gowns during such procedures. Gowns constructed according to the present invention conform substantially to the upper torso of a wearer while providing a pronouncedly flaring lower portion which extends to the ankles of the wearer. This construction permits freedom of movement both in standing and sitting positions. The upper portion of the gown, being substantially body-conforming, allows freedom of motion of the arms and upper torso without the annoyance of ballooning sections of excessive gown material. The flared configuration of the lower portion of the gown provides the wearer with the ability to spread or position the legs within a wide range of motion, both standing and sitting, without being encumbered by the restrictions of a tight fitting gown.

The gown of the present invention additionally allows one to assume a sitting position and, because of the configuration of the bottom base of each side panel, which appears as though it has had a triangular portion removed therefrom, eliminates the potential hazards of entanglement of the bottom of the gown beneath the feet of the wearer or the wheels of a movable stool.

The gown of the present invention is also provided with a liquid impervious material in a central operative field to avoid strike-through from liquids generated in high fluid procedures.

BEST MODES FOR CARRYING OUT THE INVENTION

While the present invention will be described with reference to several preferred embodiments, it should be understood that this invention is not to be construed as being limited to the embodiments described and illustrated. On the contrary, it should be understood that the present invention encompasses all alternatives, modifications and equivalents within the spirit and scope of the disclosure set forth herein.

Several terms are used herein to refer to various parts of the gown as the gown is worn. Thus, "front" refers to that part of the gown which overlays the chest or forward portions of the wearer; "back" refers to that part of the gown which overlays the back or rearward portion of the wearer; "side" or "sides" refer to that part or parts of the gown which overlays the side portion or portions of the wearer and which may extend to and overlap the back portions of the wearer. The term "outer" or "outside" describes that surface of the gown which faces away from the wearer when the gown is being worn; "inner" or "inside" refers to the surface of the gown, or part thereof, which contacts either the clothes or body of the wearer, while "left" and "right", respectively, refer to the portions of the gown corresponding to the left and right hand sides of the gown, respectively, as the gown is being worn.

Figure 1:
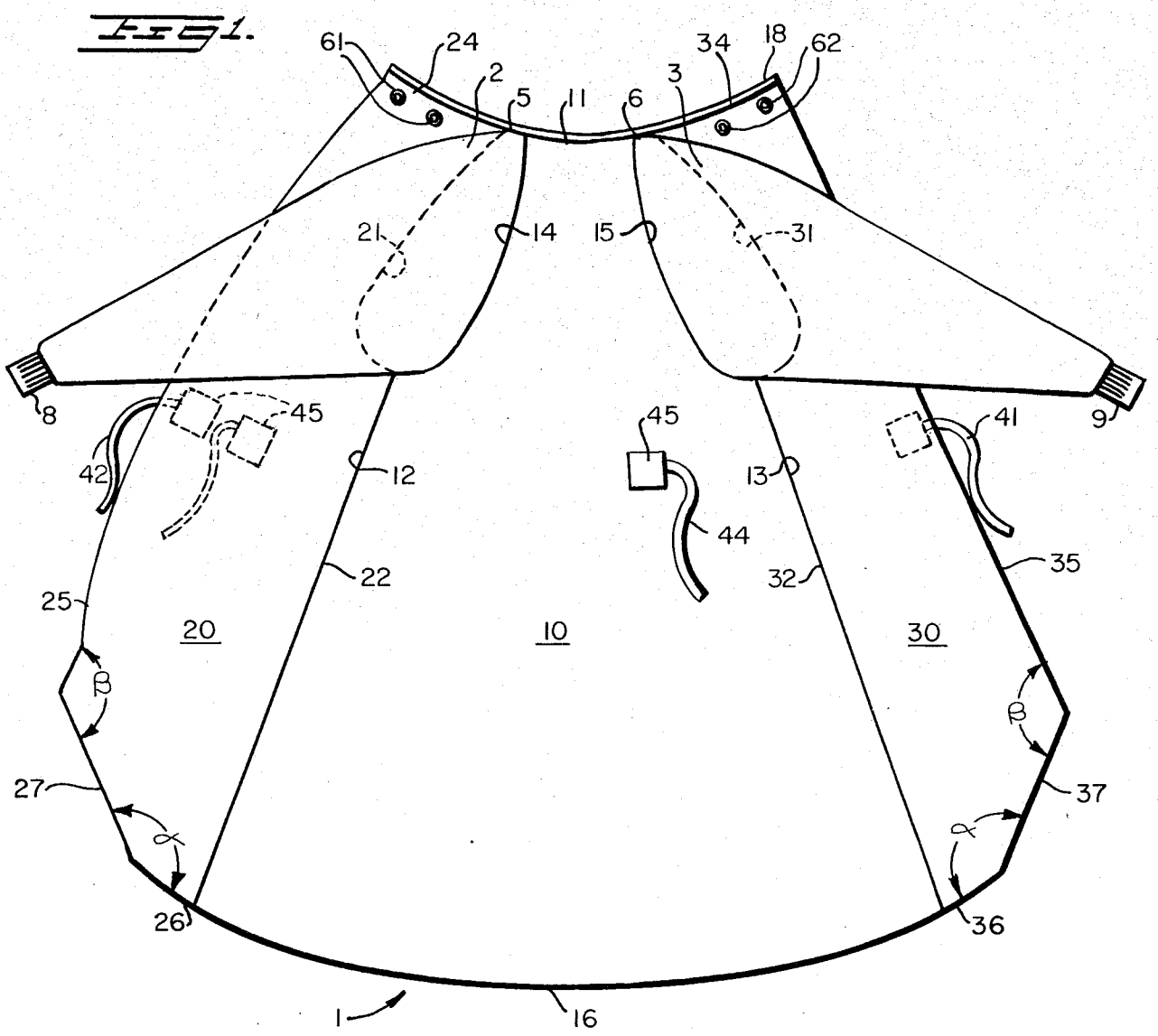
FIG. 1 is a plan view of the outside of a back-opening gown according to the present invention.
Figure 2:
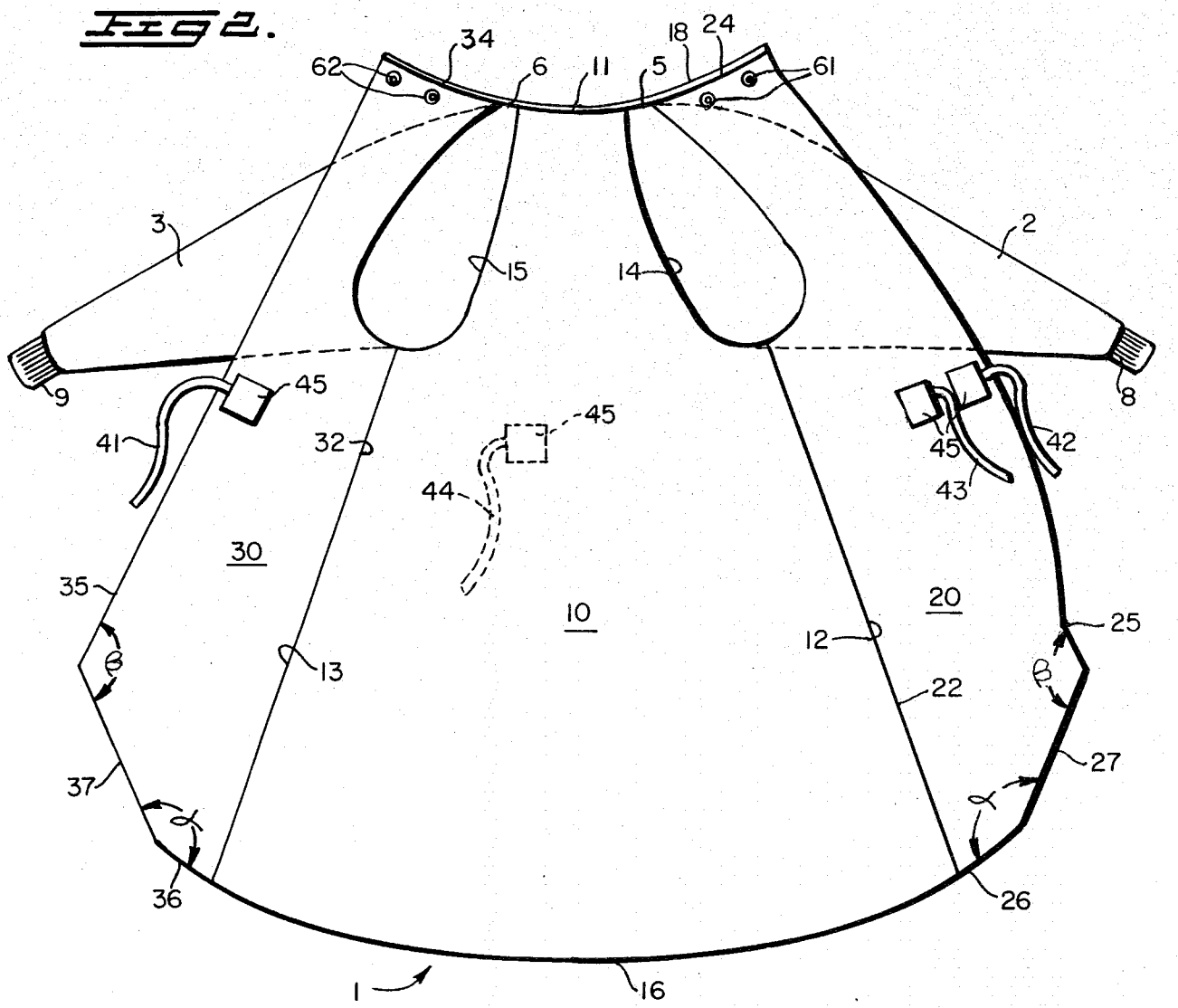
FIG. 2 is a plan view of the inside of the embodiment of the back-opening gown shown in FIG. 1.
Figure 3:
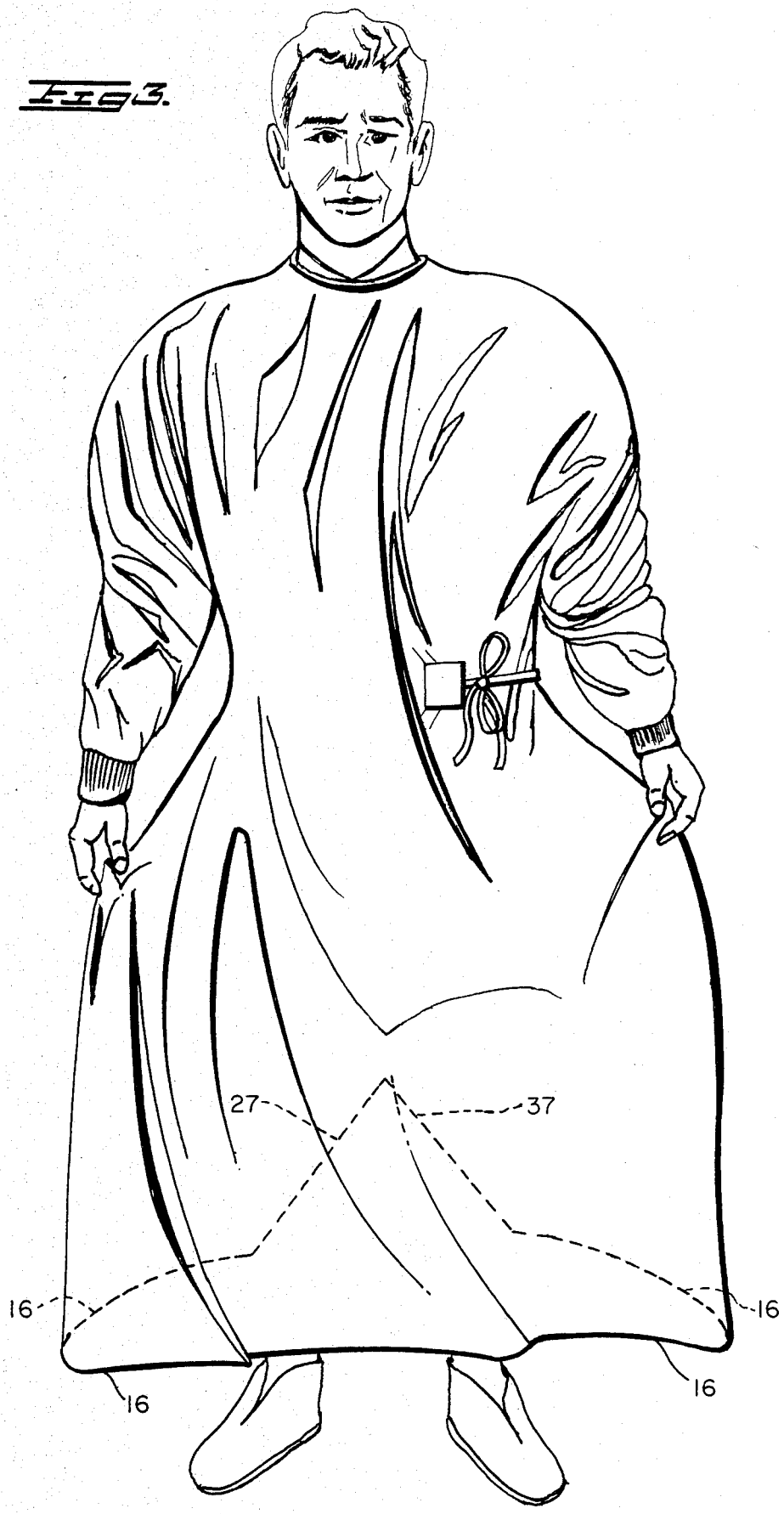
FIG. 3 is a plan view of an embodiment of the present invention worn in a standing position.

Turning now to the drawings and referring first to FIGS. 1 and 2, the gown is formed from a body portion 1 and right and left sleeves 2 and 3, respectively. The body portion 1 has a closed front section and an open back section and is formed from a front panel 10 and right and left side or back panels 20 and 30, respectively. Although the front panel may be formed in separate sections or sub-panels, it is preferably formed from a single panel of unitary construction. Each of the two side panels 20 and 30 is placed symmetrically with respect to the center line of the gown, and each is secured to both an open upper end of a sleeve portion along curved edge surfaces 21 and 31, respectively, and to lower portions of the lateral edges 12 and 13 of the front panel 10 along the inner edges 22 and 32, respectively, of the side panels. Side panels 20 and 30 may be mirror images of one another, being the same dimensions and the same but opposite shapes. Alternatively, as shown in FIGS. 1 and 2, the right or overlapping side panel 20, although generally having the same but opposite dimensions as the left panel 30, may be expanded to have a width which is greater than the left panel, particularly near the middle of the panel. This may be accomplished by providing the outer or lateral edge 25 with a gentle swelling or arcuate shape extending outwardly from the vicinity of the upper edge 34 of the side panel near the neckline to the vicinity of the midsection and tapering inwardly toward the bottom edge of the side panel. The sleeves are also secured at their upper open ends to the front panel 10 at lateral sleeve conforming edges 14 and 15. The upper edges of the front panel, side panels, and a portion of the open upper end of each of the sleeves, i.e., 11, 24, 34, 5, and 6, respectively, define a neck portion of the gown. An edge binding 18 may be secured to edges 11, 24, 34, 5, and 6 to surround the neck opening. The lateral or outer edges 25 and 35 of the side panels 20 and 30 define the back closing edges of the gown, while the bottom edge of the gown, or hemline, which is intended to extend to the ankles of the wearer (as shown in FIG. 3) is defined by front panel bottom edge 16 and, where present, side panel bottom edges 26 and 36. The front panel is shaped so that the side edges flare pronouncedly below the lateral sleeve conforming edges 14 and 15 toward the hemline 16. Preferably, the ratio of the width of the bottom of the front panel at the hemline to the width of the front panel immediately below the sleeves or lateral sleeve conforming edges 14 and 15 is about 1.7. This shape provides sufficient girth in the lower part of the gown, as illustrated in FIG. 3, to allow a wearer to spread his legs apart widely while still being body conforming in the upper portion without large excesses of material.

In a preferred embodiment, side panels 20 and 30 may be broadly characterized as parallelograms (noting, however, the departure from a straight edge of outer edge 25 in a preferred embodiment) with the inner edges 22 and 32 approximately parallel to outer edges 25 and 35, as are upper edges 24 and 34 to bottom edges 26 and 36. The lower portion of each of the side panels defined by sides 25, 27, 26, 22 and 35, 37, 36, 32 is truncated, having the appearance of having a triangular portion removed from an outer lower corner thereof. Thus, the outer opposed lower corner sections of each panel have an edge 27 and 37 which forms an obtuse angle $\alpha$ with respect to the bottom edge of the front panel or hemline 16 or, where they are present, the extensions 26 and 36 of the hemline on the bottom edge of the side panels. However, although the embodiment of the gown shown in the figures has bottom edges 26 and 36, which are approximately perpendicular to inner edges 22 and 32, respectively, another embodiment of the gown employs side panels in which the corner edges 27 and 37 intersect the inner edges 22 and 32 to form included acute angles therewith, thereby eliminating bottom edges 26 and 36 altogether. These clipped edges 27 and 37 also form an obtuse angle $\beta$ with respect to each of the outer lateral edges 25 and 35 of side panels 20 and 30, respectively. Angle $\alpha$ most preferably is about 135 degrees, varying within a suitable range of about 10 degrees in either direction, that is, between about 125 to about 145 degrees.

Figure 4:
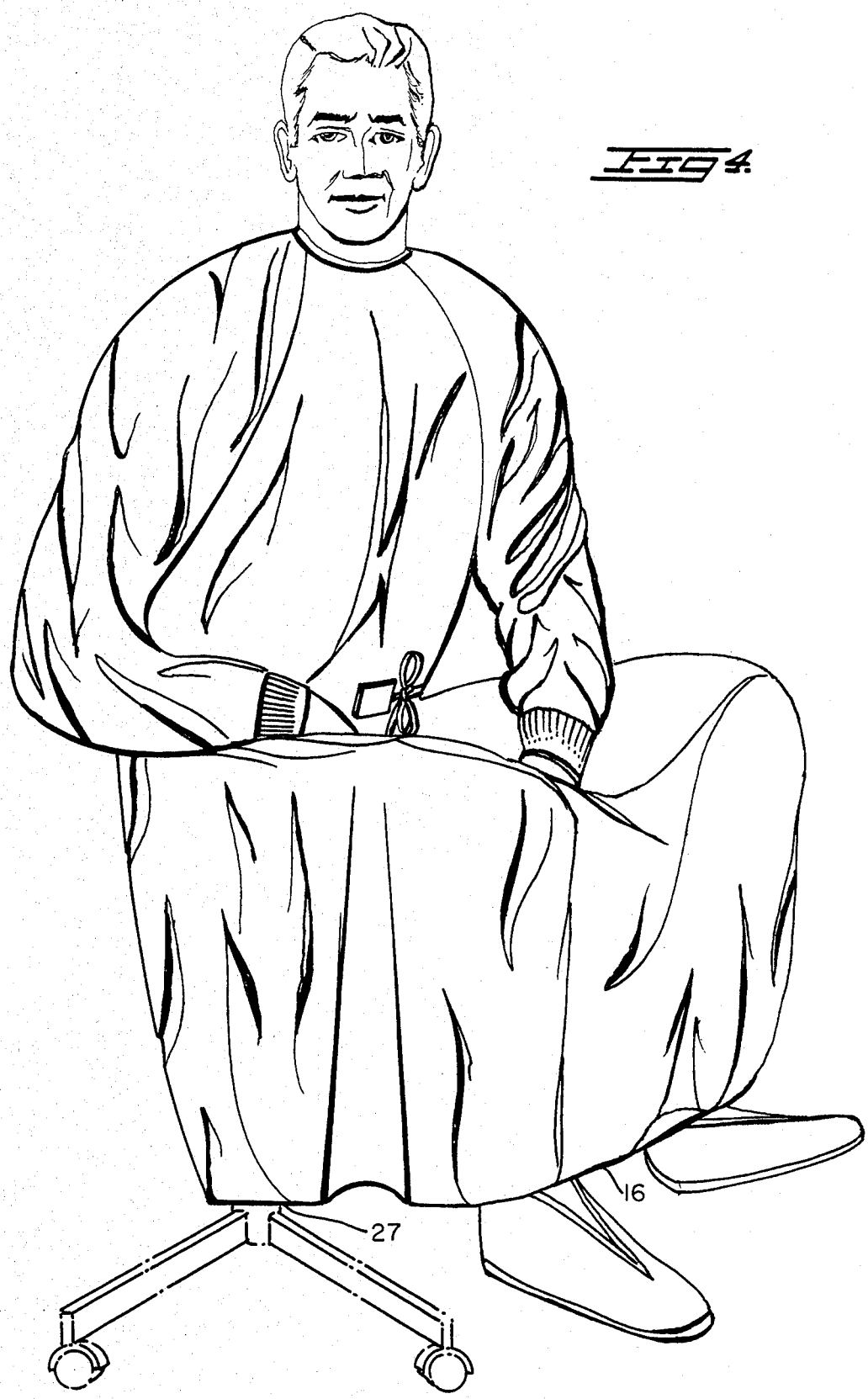
FIG. 4 is a perspective view of an embodiment of the present invention worn in a sitting position.

FIG. 4 shows the gown of the present invention as it is normally worn in a sitting position. Even with the wearer's legs arranged in a closely spaced parallel position, the bottom edge or hemline 16 of the gown reaches to or covers the ankles of the wearer while the opposed corner sections of the side panels, at edges 27 and 37, remain elevated or spaced from the floor.

When the gown of the present invention is worn by a person seated on a chair or stool of average height, such that the thighs of the wearer are approximately parallel to the floor, the clipped edges 27 and 37 will also be approximately parallel to the floor. It should be noted that, although the embodiment shown in the drawings and the discussion heretofore have been directed to corner sections in which edges 27 and 37 are straight, these sections may also be curved. In such an instance, the angle $\alpha$ referred to above should be construed to be the angle which is formed between an extension of the bottom edge of the front panel and a straight line contacting or tangent to the curved portion at a point where the curved portion is closest to a supporting surface, such as a floor, when the gown, which is proportioned to the dimensions of the wearer, is being worn by a person seated on a chair or stool of about working height, as described immediately above.

The gown of the present invention includes back closure means provided at approximately waist height and, preferably, also includes a means for closing the gown at the neck. Both the back closure means provided at the waist and the neck closure means may take the form of conventional ties, snaps or Velcro closures of the type described in U.S. Pat. Nos. 4,384,370, 3,911,499 and 3,824,625, incorporated herein by reference.

FIGS. 1 and 2 illustrate a gown provided with conventional ties. However, in the same positions or other appropriate positions, the gown may be provided with any of the aforementioned types of closures. As shown (FIG. 2), the gown is provided with ties 41 and 42 affixed to the inside surfaces of the side panels 30 and 20, respectively, in the vicinity of the outer lateral edges 35 and 25 at about waist height. Also provided on the inside of side panel 20, at about the same height as tie 42, is another tie 43. The ties are secured to the gown by sewing them or by adhesive means. As shown in FIGS. 1 and 2, adhesive patches 45 are used to affix the ties to the gown.

To close the gown, ties 41 and 43 are secured to each other and tie 42 is secured to tie 44 (FIG. 1) which is located on the outer surface of the front panel at about waist height between the centerline of the gown and side edge 13. For non-sterile procedures, the inner set of ties may be used. For sterile procedures, both the inner ties 41 and 43 and the outer ties 42 and 44 should be used to form a double layer of fabric at the back. To close the neck at the back of the gown, snaps 61 and 62 are preferably provided on side panels 20 and 30 in the vicinity of the neck opening (FIGS. 1 and 2).

Although the structure of the present invention is particularly useful with disposable or limited use gowns, it is also useful with reusable gowns. Materials useful in making gowns of the subject invention include, but are not limited to, cotton, linen, nonwoven fabric, particularly reinforced nonwoven fabric, or any woven or nonwoven fabric recognized in the art as being appropriate to the manufacture of surgical or operating room gowns.

Generally preferred for use as the base materials of the present invention are those nonwoven materials which are characterized by liquid repellency yet provide air permeability or breathability. Preferred for this purpose are those materials in which mats of microfibers, preferably melt blown (M), are laminated to one or more webs, preferably sandwiched between two webs, of continuous filaments, preferably spun bonded filaments (S), of the type described in U.S. Pat. No. 4,041,203, incorporated herein by reference.

The base fabric is preferably treated with an antistatic composition, such as the type described in "Antistatic Agents, Technology And Applications, 1972", Keith Johnson, Noyes Data Corporation, with polymeric amines and quaternary ammonium compounds and salts thereof being preferred.

It is preferred to use as the base fabric a nonwoven SMS fabric with a basis weight of 0.75 to 2.5 ounces per square yard. The most preferred base fabric is 1.4 ounce per square yard polypropylene SMS antistat treated material, which is also preferably treated for low surface tension liquid repellency.

In the central operative field of the front panel and the forearm portions of the sleeves there is provided a film or layer of a liquid impermeable material, such as polyethylene, polypropylene or polyvinyl chloride, or, preferably, a copolymer of ethylene and a small amount of vinyl acetate.

By "central operative field", as used herein, is meant the part of a surgical gown which in use is most likely to be contacted with fluids or treating liquids, such as blood, body fluids, water saline solutions or the like during the course of a surgical procedure. The size of this central operative field will depend in part upon the conditions of the surgical procedure but in high fluid procedures this "field" involves the wearer's mid-section and forearms. Thus, it is preferred that the liquid impermeable material used to prevent strike-through be placed on the inner side of the front panel from a height at or slightly above the height of the nipples extending down to the bottom edge 16 of the front panel and extending laterally to the side edges 12 and 13 and the lower ends of the sleeve inset edges 14 and 15. Extending the fluid impervious material only up to approximately the height of the nipples provides a region in the vicinity of the neck of the wearer which is air permeable, permitting increased opportunity for escape of moisture from the upper neck and chest region. In many situations involving high fluid procedures, the central operative field is so large that it is preferred to have the liquid impermeable material extend to the neckline 11, that is, coextensive with the front panel 10. The central operative field may be rendered impervious by adhering, sewing or extruding the liquid impermeable layer onto the base fabric material. Preferably, the nonwoven fabric described above is extrusion-coated with polyethylene in accordance with the teaching of U.S. Pat. No. 3,663,348, which patent is hereby specifically incorporated by reference.

The material preferred for use in the central operative field of the present invention, particularly the front panel, is the aforementioned 1.4 ounce per square yard SMS nonwoven fabric, treated to be antistatic and liquid repellent, and provided with a 1.25 mil thick, low density polyethylene with 9 percent ethylene vinyl acetate film, extrusion-laminated to the SMS material.

The liquid impermeable material placed inside the distal or forearm portions of the sleeves extends downward to the cuffs of the sleeves or to the edges of the sleeves which join elastic or knitted cuff portions 8 and 9 and up to the region of the elbows or slightly beyond. In certain high fluid surgical procedures it may be desirable to have the liquid impermeable material coextensive with the inside of the sleeves.

To reduce the clammy feeling of the liquid impermeable layer in contact with the skin of the forearms and to absorb any perspiration generated during the procedure, an absorbent tissue or cellulose wadding is secured to the liquid impermeable film or layer by any well known securing means, thereby sandwiching the liquid impermeable film between the inner absorbent tissue layer and the outer, nonwoven liquid repellent, air permeable fabric layer. The preferred absorbent tissue is a tissue fiber laminate of the type described in U.S. Pat. Nos. 3,668,050 or 3,484,330 (incorporated herein by reference).

Preferably, the sleeve is reinforced with a single ply tissue, polyester fiber laminate (plastisol bonded) to which 0.75 mil polyvinyl chloride film (such as Clopay LW 75, available from the Clopay Film Corporation) is heat laminated. The total weight of the fabric at 51.5 grams per square yard is comprised of 20.5 grams per square yard of film.

The component parts of the gown of the present invention may be joined to one another by any known means for securing such parts in this type of garment.

Thus, the sleeves, side panels and front panel, knitted cuffs and closure means may be attached by sewing, adhering with adhesives, or, where suitable heat sealing.

Figure 5:
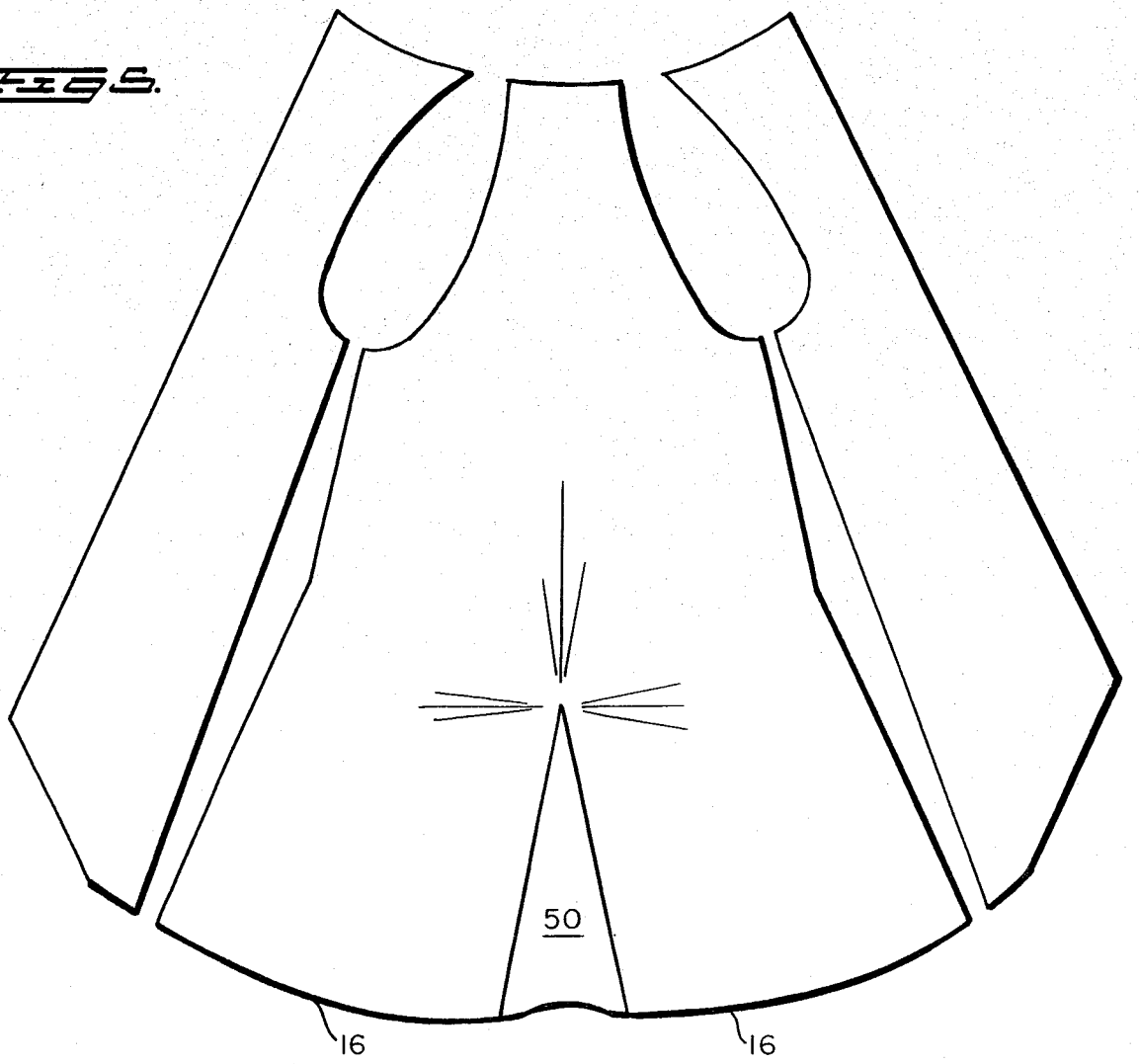
FIG. 5 is an exploded plan view of the outside of another embodiment, less the sleeves, of a back-opening gown according to the present invention.

FIG. 5 shows another embodiment of the gown of the present invention, minus the sleeves. A substantially triangular insert 50 is seamed, adhered or otherwise secured to the edges of a slit formed vertically in the center of the front panel from the bottom edge 16 of the front panel to approximately groin height. The triangular insert is formed from essentially the same material as the central operative field of the front panel; that is, the triangular insert is preferably formed from SMS having extruded thereon or adhered thereto a thin sheet of polyethylene or a copolymer of ethylene and vinyl acetate. Alternatively, the triangular insert of SMS may be attached to the front panel and thereafter another triangular portion of polyethylene may be adhered to the SMS insert from behind, possibly overlapping the main portion of the front panel beyond the slit. Still another alternative is to employ a material in which a film, such as polyethylene, is laminated to a spun bonded fibrous material as the triangular insert.

The triangular insert, or the entire front panel of the gown may be folded so that a fold is formed at approximately the centerline of the gown facing inward toward the wearer's body. This reduces the girth of the lower portion of the gown when it is worn in a standing position and also channels fluids so that they readily drain off the gown when it is worn in a sitting position.

Lastly, the gowns described herein, although expected to have greatest utility as disposable surgical gowns, are also anticipated to have application to other situations where protection is needed in high fluid operations and mobility of the wearer's legs is required.

I claim:

1. A back-opening gown of nonwoven material comprising:

a pair of sleeves;

a front panel joined at its upper lateral edges to said sleeves, said front panel flaring pronouncedly below said sleeves;

a pair of side panels attached to said sleeves and to the lateral edges of said front panel below said sleeves, each of said side panels having a lower opposed corner section, the edge of said corner section forming an obtuse angle with respect to the bottom edge of said front panel in the range of about 125 to about 145 degrees; and back closure means, the gown being constructed so that the upper portion of said gown conforms substantially to the torso of the wearer, said gown extending from the neck to the ankles of a wearer and said flaring front panel providing girth to the lower portion of said gown to permit the wearer to spread his legs while in a seated position without being constrained by the gown material, and the angled edges of the corner sections causing the edges of the sections to be located clear of a floor while the wearer is seated.

2. The back-opening gown according to claim 1 wherein said obtuse angle is about 135 degrees.

3. The back-opening gown according to claim 1 wherein said front panel includes a central operative field comprising a liquid impermeable material.

4. The back-opening gown according to claim 3 wherein said central operative field extends substantially to the bottom edge of said front panel and laterally to the lateral edges of said front panel.

5. The back opening gown according to claim 4 wherein said central operative field extends downward from about the nipples of the wearer.

6. The back-opening gown according to claim 3 wherein said central operative field is coextensive with said front panel.

7. The back-opening gown according to claim 1 wherein the lower portion of said front panel includes a substantially triangular insert.

8. The back-opening gown according to claim 1 wherein said gown is disposable.

9. The back-opening gown according to claim 1 wherein said sleeves include a central operative field comprising a liquid impermeable material.

10. The back-opening gown according to claim 1 wherein one of said side panels adapted to overlap the other of said side panels is wider than said other of said side panels.

11. The back-opening gown according to claim 10 wherein said one of said side panels has an arcuately shaped outer lateral edge providing the greatest width near the midsection of said one of said side panels.

12. A disposable back-opening gown of nonwoven material comprising:

a pair of sleeves which include an operative field having a liquid impermeable material;

a front panel joined at its upper lateral edges to said sleeves and flaring pronouncedly below said sleeves, said front panel including a central operative field having a liquid impermeable material coextensive with said front panel;

a pair of side panels attached to said sleeves and to the lateral edges of said front panel below said sleeves, each of said side panels having a lower opposed corner section, the edge of said corner section forming an angle of about 135 degrees with respect to the bottom edge of said front panel, one of said pair of side panels adapted to overlap the other of said side panels and having an arcuately shaped outer lateral edge so that the width of said one of said side panels is greater than that of said other of said side panels near the midsection of said one of said side panels; and back closure means, the gown being constructed so that the upper portion of said gown conforms substantially to the torso of the wearer, said gown extending from the neck to the ankles of a wearer and said flaring front panel providing girth to the lower portion of said gown to permit the wearer to spread his legs while in a seated position without being constrained by the gown material, and the angled edges of the corner sections causing the edges of the sections to be located clear of a floor while the wearer is seated.

* * * * *